US010511096B2

(12) United States Patent
Haziza

(10) Patent No.: US 10,511,096 B2
(45) Date of Patent: Dec. 17, 2019

(54) LOW COST DIELECTRIC FOR ELECTRICAL TRANSMISSION AND ANTENNA USING SAME

(71) Applicant: Wafer LLC, Hanover, NH (US)

(72) Inventor: Dedi David Haziza, Kiryat Motzkin (IL)

(73) Assignee: WAFER LLC, Hanover, NH (US)

( * ) Notice: Subject to any disclaimer, the term of this patent is extended or adjusted under 35 U.S.C. 154(b) by 0 days.

(21) Appl. No.: 15/968,169

(22) Filed: May 1, 2018

(65) Prior Publication Data

US 2019/0341693 A1 Nov. 7, 2019

(51) Int. Cl.

| | |
|---|---|
| ***H01Q 1/38*** | (2006.01) |
| ***H01Q 9/04*** | (2006.01) |
| ***H01Q 1/48*** | (2006.01) |
| ***H01P 11/00*** | (2006.01) |
| ***H01P 1/18*** | (2006.01) |
| *H01Q 5/00* | (2015.01) |
| *H01Q 1/40* | (2006.01) |
| *H01Q 1/42* | (2006.01) |

(52) U.S. Cl.

CPC ..... *H01Q 9/0407* (2013.01); *H01P 1/181* (2013.01); *H01P 11/00* (2013.01); *H01Q 1/48* (2013.01); *H01Q 1/40* (2013.01); *H01Q 1/405* (2013.01); *H01Q 1/422* (2013.01)

(58) Field of Classification Search

CPC ..... H01Q 1/40; H01Q 1/405; H01Q 1/422
USPC ..... 343/700 MS, 911 R, 873
See application file for complete search history.

(56) References Cited

U.S. PATENT DOCUMENTS

| | | | | |
|---|---|---|---|---|
| 6,335,699 | B1 | 1/2002 | Honma | |
| 2009/0278744 | A1 | 11/2009 | Kirino et al. | |
| 2010/0060535 | A1* | 3/2010 | Tiezzi ..... | H01Q 1/3275 343/770 |

FOREIGN PATENT DOCUMENTS

| | | | |
|---|---|---|---|
| JP | 2000-236207 | A | 8/2000 |
| JP | 2000-315902 | A | 11/2000 |
| JP | 2003-017912 | A | 1/2003 |
| JP | 2004-023228 | A | 1/2004 |

OTHER PUBLICATIONS

Dolfi, D., et al., "Liquid Crystal Microwave Phase Shifter," Electronics Letters, vol. 29, No. 10, May 13, 1993.

* cited by examiner

*Primary Examiner* — Binh B Tran
(74) *Attorney, Agent, or Firm* — Womble Bond Dickinson (US) LLP; Joesph Bach, Esq.

(57) ABSTRACT

A transmission conduit for RF signal, comprising: a dielectric plate; a conductive circuit positioned on one surface of the dielectric plate; a conductive ground positioned on opposite surface of the dielectric plate; wherein the dielectric plate comprises a sandwich of at least one high-dielectric constant layer and one foam plate. The dielectric plate can be made of a sandwich of glass and foam plate, such as Rohacell®. The glass and foam plates have thickness calculated to give the sandwich the required overall dialectic constant.

20 Claims, 3 Drawing Sheets

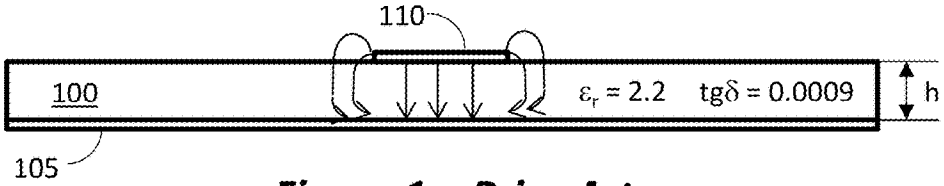
Figure 1 – Prior Art
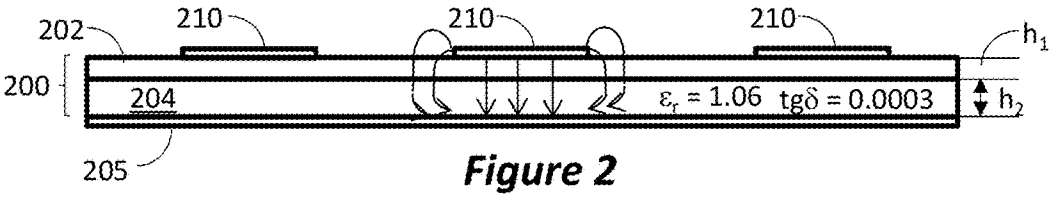
Figure 2
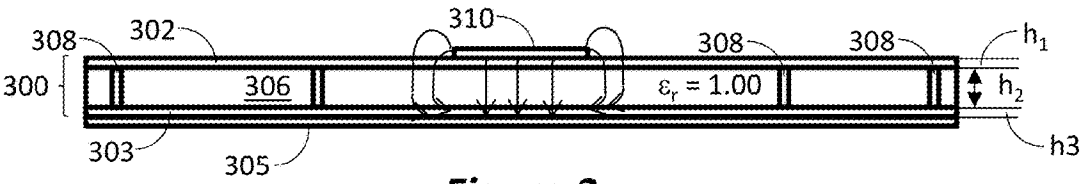
Figure 3
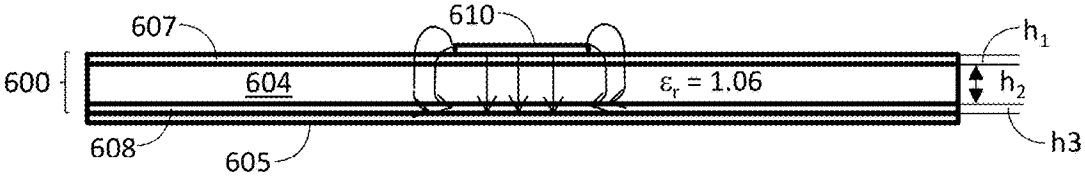
Figure 6

| | Amp | Phase |
|---|---|---|
| S12 | -3dB | 0 |
| S13 | -3dB | 90deg |
| S14 | Iso. | NA |
| S43 | -3dB | 0 |
| S42 | -3dB | 90deg |
| s41 | Iso. | NA |

LOW COST DIELECTRIC FOR ELECTRICAL TRANSMISSION AND ANTENNA USING SAME

BACKGROUND

1. Field

This disclosure relates generally to the field of dielectric materials, used for insulating electrical conductors. The disclosed dielectric is particularly suitable for RF transmission lines, such as lines used for conducting RF signals for antennas.

2. Related Art

Common methods of conducting electromagnetic energy between locations are to use a circuit board with microstrip printed technology or using a metallic wave-guide. The advantage of a circuit board over a waveguide is that it can be produced in higher volumes and is flat. The disadvantage is the loss which is proportional to the distance the high frequency electronic signal travels. The advantage of a metallic wave-guide is that it operates with lower losses, but the disadvantage is that it is neither as thin as a circuit board nor as cost effective.

Some circuit board substrates are designed to have low propagation losses. The typical low loss substrate is a mixture of Teflon and glass. However, these Circuit Boards are more expensive because of the process of pressing the Teflon and glass flat, which requires tremendous pressure.

One problem with many low loss materials like Polytetrafluoroethylene, (commonly called Teflon®), is that the thermal expansion and contraction rates for these materials is very different than that for the conductive metals, which they would otherwise be bonded to. For example, if a copper line is formed on Teflon, the Teflon will expand with temperature at a different rate than the copper, and therefore de-laminate the copper. The current art for dealing with this expansion problem is to load the Teflon material with glass to reduce its coefficient of thermal expansion, along with substantial other processes.

Another problem with many low loss materials like Teflon is that they have low surface energy, making it difficult to bond to a conductive circuit. In many instances, glues, or other adhesives are used and these materials have negative RF propagation factors.

A further disadvantage of Teflon is its high cost. In many modern applications the entire transmission circuitry needs to be of very low cost, which makes Teflon prohibitive.

Rohacell® is a polymethacrylimide (PMI) based structural foam, marketed by Evonik Rohm GmbH, of Darmstadt, Germany. Rohacell has a relatively low dielectric constant, $\varepsilon_r$, of about 1.046 to 1.093, depending on the particular formulation. Foam, such as Rohacell, has been used as dielectric in RF systems, as exemplified in U.S. Publication 2015/0276459, titled: Foam Filled Dielectric Rod Antenna.

Accordingly, a need exists in the art for improved transmission vehicles for electromagnetic energy, which can be used, e.g., in antennas used for wireless communication.

SUMMARY OF THE INVENTION

The following summary of the disclosure is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Disclosed embodiments provide a flat and low cost dielectric material. In disclosed examples the embodiments are applied to an antenna, but it could be applied to other devices which require high frequency electronic transmission, such as microwaves, radars, LIDAR, etc.

In the disclosed embodiments electrical conductors are separated by a dielectric material. The disclosed dielectric material may be used a replacement to Teflon® for any application that currently uses Teflon. While Teflon possesses high performance characteristics, it is of relatively high cost. The disclosed embodiments can provide comparable performance as Teflon, but at a much lower cost.

In general aspects, the dielectric plate is made of a sandwich of at least two plates, one having high dielectric constant, such as glass, and another having dielectric constant as close as possible to that of air. A good example for glass is Vycor® glass, while a good example for material having dielectric constant close to air is foam, such as structural foam, e.g., Rohacell®. The foam should have dielectric constant of from 1.0 to 1.1

Disclosed embodiments include antenna array having multiple radiating elements over a variable dielectric constant (VDC) material. The ability to change the VDC provides control of the parameters of the antenna, including steering, using software. The dielectric layers separating the various elements of the antenna are implemented using sandwich of glass and foam plates. The ratio of the thickness of glass to that of the foam is calculated such that the dielectric constant experienced by the field amounts to a desired total dielectric constant. Specifically, the total dielectric constant can be increased by increasing the relative thickness of glass compared with foam, or reduced by decreasing the relative thickness of glass relative to the thickness of the foam.

Other embodiments provide non-radiating electrical devices having conductive lines separated by dielectric sandwich of glass plate and foam plate.

Disclosed embodiments provide transmission conduit for RF signal, comprising: a dielectric plate; a conductive circuit positioned on one surface of the dielectric plate; a conductive ground positioned on opposite surface of the dielectric plate; wherein the dielectric plate comprises a sandwich of at least one high-dielectric constant layer and one foam plate. The high-dielectric constant layer is formed to have a dielectric constant of 3.8-4.4. The high-dielectric constant layer may be formed of glass, PET, etc. The foam is formed to have a dielectric constant of 1.0 to 1.1. The dielectric plate may be a foam plate sandwiched between a top polyethylene terephthalate (PET) layer, a bottom PET layer. The conductive circuit can comprise at least one radiating patch or an electrical circuitry defining a hybrid coupler.

In other embodiments, an antenna is provided, comprising: an insulating spacer; at least one radiating patch provided on top of the insulating spacer; at least one delay line provided below the insulating spacer; a variable dielectric constant (VDC) layer provided below the delay line; a dielectric plate; a ground plane provided below the dielectric plate; a bottom insulating plate provided below the ground plane; and, a feed line provided below the bottom insulating plate; wherein at least one of: the insulating spacer, the dielectric plate, and the bottom insulating plate, comprises at least one high-dielectric constant layer and one foam plate. The high-dielectric constant layer may comprise one of: Polytetrafluoroethylene, Polyethylene terephthalate (PET), glass fiber impregnated Polypropylene, or glass plate. The high-dielectric constant layer is formed to have a dielectric constant of 3.8-4.4. The foam is formed to have a dielectric constant of 1.0 to 1.1. The antenna may further comprise conductive electrodes abutting the VDC layer. At least one of: the insulating spacer, the dielectric plate, and the bottom insulating plate, may comprise a foam plate sandwiched between two glass plates or a foam plate sandwiched between two PET plates. The antenna may further comprise at least one conductive via connecting each one of the delay lines to a corresponding radiating patch. The ground plane can comprise at least one window, each aligned below a corresponding one of the radiating patches.

According to further embodiments, a method for fabricating an RF transmission conduit is provided, comprising: forming a conductive circuit over a top surface of an insulating plate, the insulating plate comprising one of glass plate or Polyethylene terephthalate (PET); attaching a ground plane to a bottom surface of a foam plate; adhering the insulating plate to the foam plate. Attaching a ground plane may comprises one of: forming the ground plane directly on the bottom surface of the foam plate; or forming the ground plane on a second insulating plate and adhering the second insulating plate to the bottom surface of the foam plate. The second insulating plate may be formed of one of glass plate or Polyethylene terephthalate (PET).

BRIEF DESCRIPTION OF THE DRAWINGS

Other aspects and features of the invention would be apparent from the detailed description, which is made with reference to the following drawings. It should be appreciated that the detailed description and the drawings provides various non-limiting examples of various embodiments of the invention, which is defined by the appended claims.

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 1 is a cross-section of a prior art structure utilizing dielectric such as Teflon.

FIG. 2 illustrates an embodiment of the dielectric for a transmission apparatus.

FIG. 3 illustrates yet another embodiment of the transmission apparatus.

FIG. 6 illustrates a variant embodiment for an RF transmission conduit.

DETAILED DESCRIPTION

Figure 4A:
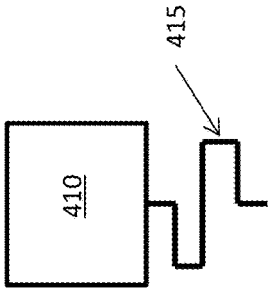
FIGS. 4A and 4B illustrate an embodiment for a software controlled antenna utilizing the disclosed dielectric sandwich.

Embodiments of the inventive dielectric sandwich will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments.

FIG. 1 illustrates a cross-section of a prior art device that utilizes Teflon as the dielectric material 100. In this example, the dielectric constant of the Teflon is $\varepsilon_r$=2.2, while its loss factor (loss tangent–Ohmic losses) is tgδ=0.0009. A ground conductor 105 is provided on the bottom of the dielectric 100, and a conducting and/or radiating electrode 110, such as a microstrip, is provided on top of the dielectric 100. The thickness of the dielectric is indicated as h.

The open-head arrows in FIG. 1 illustrate the resulting field. As illustrated in FIG. 1, part of the field travels only through the dielectric material, but some part of the field travels through both air and the dielectric material. Therefore, the effective dielectric constant is some average of the dielectric constant of the air and the dielectric constant of the Teflon (or other dielectric material used). The effective dielectric constant correlates to the square root of the product of the two dielectric constants, weighted by the effective volume. Since in the drawing of FIG. 1 the dielectric constant of air is 1, the effective dielectric constant of the structure of FIG. 1 equals that of the Teflon.

FIG. 2 illustrates a general embodiment utilizing the innovative dielectric arrangement. In the embodiment of FIG. 2, the dielectric sandwich 200 is made up of two materials: a plate 202 having high dielectric constant, e.g., Polytetrafluoroethylene, Polyethylene terephthalate (PET), glass fiber impregnated Polypropylene, or glass plate, and a plate of material having dielectric constant close to that of air, for example a structural foam that is mostly air, like, e.g., Rohacell 204. The ratio of the thicknesses of the two plates, h1/h2, is calculated to achieve the desired effective dielectric constant. For example, in the embodiment of FIG. 2, a Vycor® glass may be used. Vycor glass is a high silica glass marketed by Corning, and has a very low thermal coefficient of expansion. Depending on the formula used for fabrication, Vycor glass can have a dielectric constant of 3.8-4.4, with loss factor of 0.0003. The plate 204, made of Rohacell, has a dielectric constant of about 1.06 and loss factor of 0.0003. Thus, in this example, when making the thicknesses of both plates the same, i.e., h1/h2=1, the effective dielectric constant is $\varepsilon_r$=2.159, while the effective loss factor (serially additive) is tgδ=0.0009.

From the example of FIG. 2, it can be seen that disclosed embodiments provide a dielectric consisting of multiple layers of insulating materials contiguous with each other, thereby creating a low loss dielectric that may be tailored to have an effective dielectric similar to Teflon. The top layer in one example is made of a plate of glass. In FIG. 2 an array of three radiating elements 210 are shown, although for clarity the field lines of only one radiating element 210 are shown.

FIG. 3 illustrates a cross-section of another embodiment utilizing a multiple layers dielectric approach. The dielectric sandwich 300 of the embodiment of FIG. 3 is made up of three layers: a first glass plate 302, a second glass plate 303, and a space 306 that is filled with air. The plates 302 and 303 are held apart with exact separation h2 using the spacers 308. The ground plate is formed on the bottom face of glass 303, while the transmission line or radiating electrode are formed on the top surface of glass 302. The thicknesses, h1 and h3, of glass plate 302 and glass plate 303, respectively, are calculated to provide the desired effective dielectric constant, once calculated with the layer 306 of air in between. In this case, if one makes h1+h3=h2, i.e., the thickness of the top glass plate plus the thickness of the bottom glass plate equals the air separation, then the effective dielectric constant is 2.09.

Thus, the embodiment of FIG. 3 provides a dielectric plate made out of two plates separated using spacers to form air gap in between the two plates. Each of the plate may be made of glass, such as Vycor glass. Additionally, the spacers may also be made of Vycor glass. A ground plate may be formed on one glass, while the conductive line of radiating patch may be formed on the other glass plate.

Thus, as can be understood, according to one aspect, a radiating device is provided, comprising: a dielectric plate; a conductive ground plane formed on bottom surface of the dielectric plate; and a radiating element formed on top surface of the dielectric plate; wherein the dielectric plate comprises a plate of glass and a plate of foam.

Figure 4B:
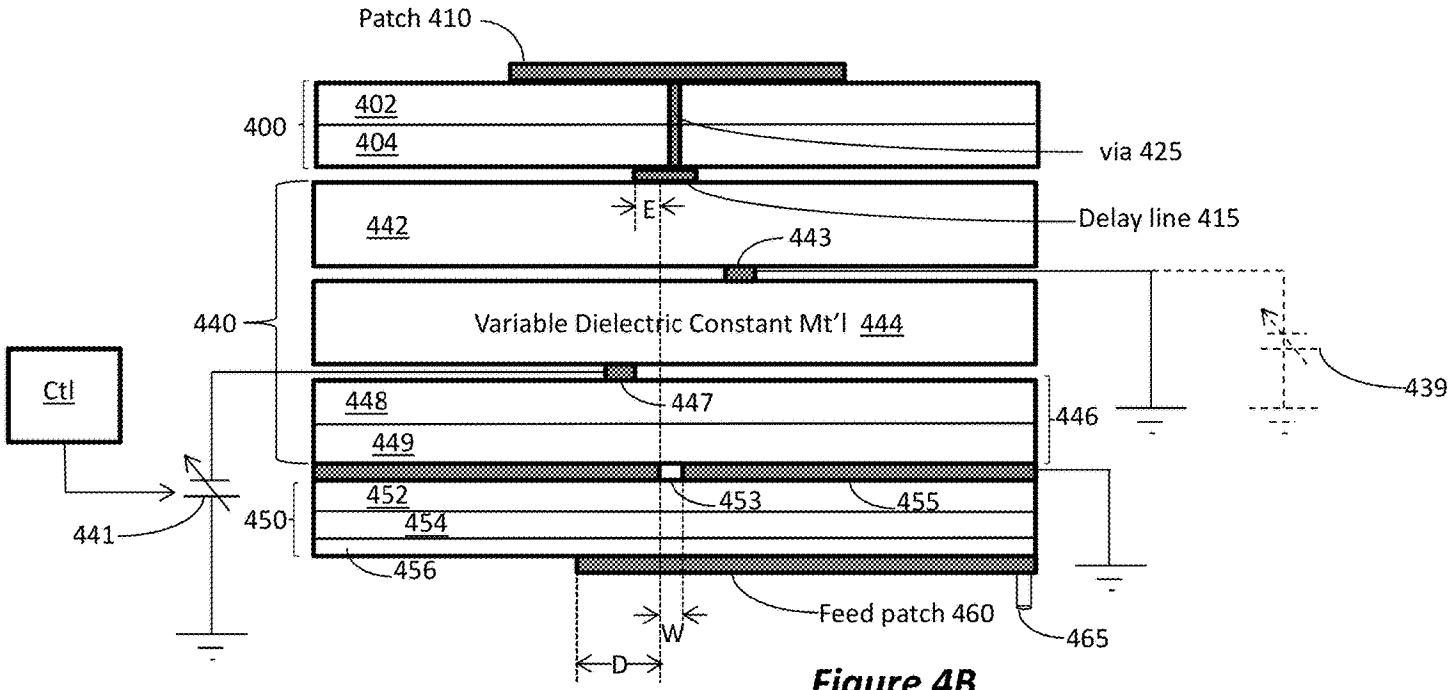

An example of a radiating device made using the innovative dielectric sandwich is shown in FIGS. 4A-4B. In U.S. patent application Ser. No. 15/654,643, Applicant disclosed a multi-layered software defined antenna which utilizes an array of radiating devices similar to that of FIGS. 4A-4B, thus only relevant parts relating to one of the radiating elements will be repeated herein. FIG. 4B is a cross-section of the device shown in top view in FIG. 4A, which is one example showing a multi-layered software defined antenna constructed using the dielectric sandwich disclosed herein.

The radiating patch is indicated as patch 410 and the delay line is indicated as conductive line 415. The radiating patch is formed on a top dielectric spacer 400 is generally in the form of a dielectric (insulating) plate or a dielectric sheet, but in this embodiment is made of a dielectric sandwich consisting of glass plate 402 and foam plate 404, e.g., Rohacell. The radiating patch 410 is formed on the top surface of the glass by, e.g., adhering a conductive film, sputtering, printing, etc. At the patch location, a via 425 is formed in the glass 402 and foam 404, and a conductor is passed through the via and is connected to the back surface of the patch 410. A delay line 415 is formed on the bottom surface of foam plate 404 (or on top surface of upper binder 442), and is connected physically and electrically to conductor in via 425. That is, there is a continuous DC electrical connection from the delay line 415 to radiating patch 410, through contact in via 425. As shown in FIG. 4A, the delay line 415 is a meandering conductive line and may take on any shape so as to have sufficient length to generate the desired delay, thereby causing the desired phase shift in the RF signal.

The delay in the delay line 415 is controlled by the variable dielectric constant (VDC) plate 440 having variable dielectric constant material 444. While any manner for constructing the VDC plate 440 may be suitable for use with the embodiments of the antenna, as a shorthand in the specific embodiments the VDC plate 440 is shown consisting of upper binder 442, (e.g., glass, PET, etc.) variable dielectric constant material 444 (e.g., twisted nematic liquid crystal layer), and bottom binder 446. In other embodiments one or both of the binder layers 442 and 444 may be omitted. Alternatively, adhesive such as epoxy or glass beads may be used instead of the binder layers 442 and/or 444. Also, as illustrated in FIG. 4B, one or both of the binders may be constructed as a sandwich according to the embodiments disclosed herein. As an example, bottom binder 446 is shown as a two layer sandwich having a foam plate 448 and a glass plate 449.

In some embodiments, e.g., when using twisted nematic liquid crystal layer, the VDC plate 440 also includes an alignment layer that may be deposited and/or glued onto the bottom of the upper binder 442. The alignment layer may be a thin layer of material, such as polyimide-based PVA, that is being rubbed or cured with UV radiation in order to align the molecules of the LC at the edges of confining substrates.

The effective dielectric constant of VDC plate 440 can be controlled by applying DC potential across the VDC plate 440. For that purpose, electrodes are formed and are connected to controllable voltage potential. There are various arrangements to form the electrodes, and several examples will be shown in the disclosed embodiments. In the arrangement shown in FIG. 4B, two electrodes 443 and 447 and provided—one on the bottom surface of the upper binder 442 and one on the upper surface of the bottom binder 446. As one example, electrode 447 is shown connected to variable voltage potential 441, while electrode 443 is connected to ground. As one alternative, shown in broken line, electrode 443 may also be connected to a variable potential 439.

Thus, by changing the output voltage of variable potential 441 and/or variable potential 439, one can change the dielectric constant of the VDC material in the vicinity of the electrodes 443 and 447, and thereby change the RF signal traveling over delay line 415.

Changing the output voltage of variable potential 441 and/or variable potential 439 can be done using a controller, Ctl, running software that causes the controller to output the appropriate control signal to set the appropriate output voltage of variable potential 441 and/or variable potential 439. Similarly, a conventional controller can be used to provide the control and common signals to control the characteristics of the antenna. Thus, the antenna's performance and characteristics can be controlled using software—hence software controlled antenna.

At this point it should be clarified that in the subject description the use of the term ground refers to both the generally acceptable ground potential, i.e., earth potential, and also to a common or reference potential, which may be a set potential or a floating potential. For example, conventional LCD display controllers output two signals per pixel, one of which is referred to as the ground or common signal. Similarly, while in the drawings the symbol for ground is used, it is used as shorthand to signify either an earth or a common potential, interchangeably. Thus, whenever the term ground is used herein, the term common or reference potential, which may be set or floating potential, is included therein.

In transmission mode the RF signal is applied to the feed patch 460 via connector 465 (e.g., a coaxial cable connector). As shown in FIG. 4B, there is no electrical DC connection between the feed patch 460 and the delay line 415. However, in disclosed embodiments the layers are designed such that an RF short is provided between the feed patch 460 and delay line 415. As illustrated in FIG. 4B, a back plane conductive ground (or common) 455 is formed on the top surface of backplane insulator (or dielectric) 450 or the bottom surface of bottom binder 446. The back plane conductive ground 455 is generally a layer of conductor covering the entire area of the antenna array. At each RF feed location a window (DC break) 453 is provided in the back plane conductive ground 455. The RF signal travels from the feed patch 460, via the window 453, and is coupled to the delay line 415. The reverse happens during reception. Thus, a DC open and an RF short are formed between delay line 415 and feed patch 460. The backplane insulator 450 can also be constructed according to embodiments disclosed herein, which in this example includes glass plate 452, foam plate 454, and glass plate 456.

Thus, as can be understood, according to one aspect, a radiating device is provided, comprising: a dielectric plate; a radiating element formed on top surface of the dielectric plate; a dielectric back-plate; a conductive ground plane formed on bottom surface of the dielectric back-plate; a variable dielectric constant material sandwiched between the dielectric plate and the dielectric back-plate; and wherein at least one of the dielectric plate and dielectric back-plate comprises a plate of glass and a plate of foam.

As illustrated so far, the embodiments disclosed herein can be used for radiating elements, such as antennas and antenna arrays. However, according to aspects of the invention, electronic devices or components can also be provided, which have variable electrical characteristics or operation based on potential applied to a variable-dielectric constant sector associated with the device and incorporate the low-cost dielectric sandwich. According to aspects of the invention, the electronic devices or component may include bends, power splitters, filters, ports, phase shifters, frequency shifters, attenuators, couplers, capacitors, inductors, diplexers, hybrids of beam forming networks, and may also include radiating elements in addition to the electronic devices. Notably, several devices can be formed on the same dielectric sandwich, just like was done in the prior art using Rogers® or PCP.

Figure 5:
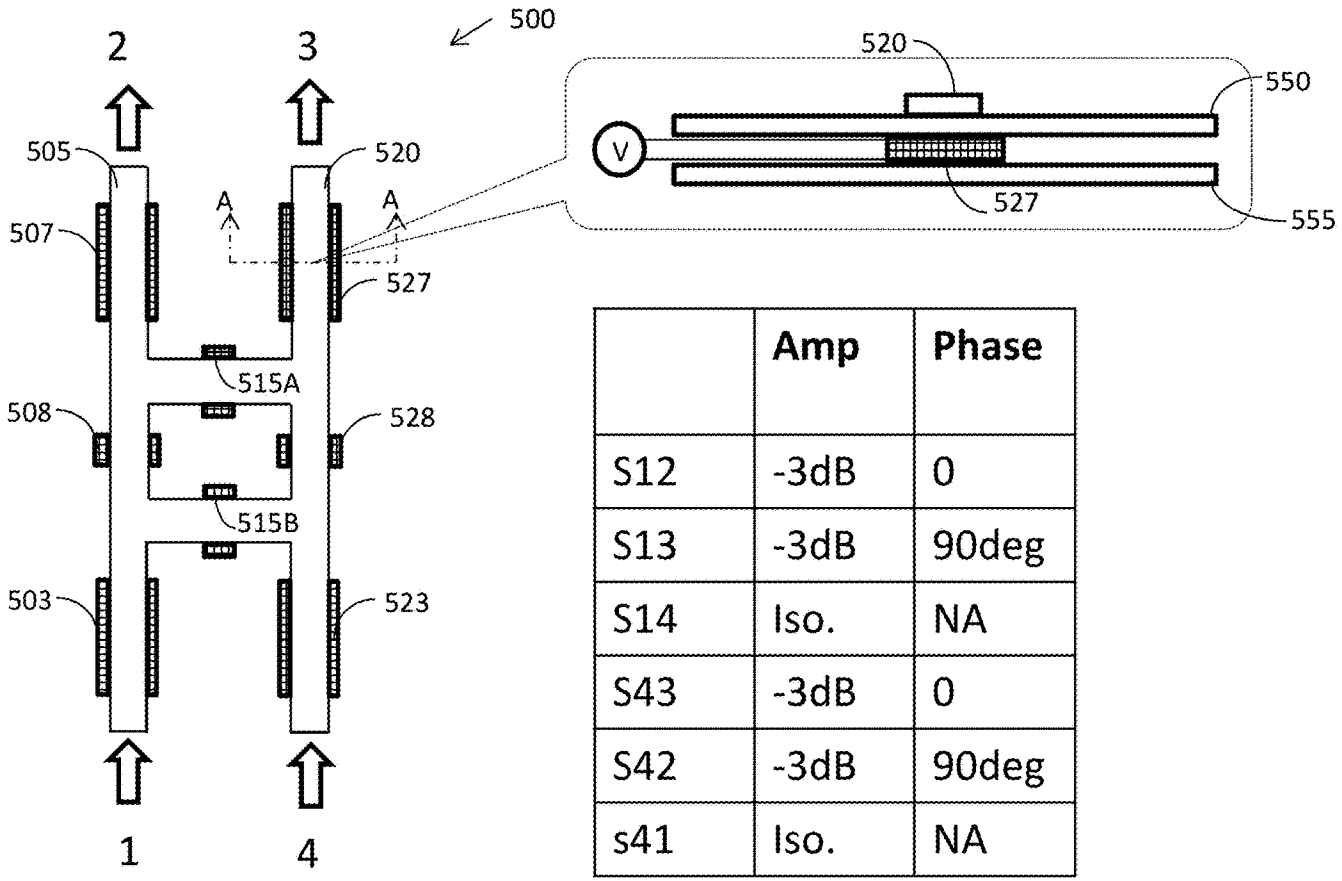
FIG. 5 illustrates an embodiment for a non-radiating electronic device utilizing the disclosed dielectric sandwich.

According to disclosed aspects, the electronic devices disclosed in Applicant's U.S. Patent Application Ser. No. can be modified using the sandwich dielectric plate, to thereby provide the same performance, at a much lower cost. FIG. 5 illustrates an embodiment of a four-ports hybrid coupler 500. Without any VDC's the signal input at port 1 splits into output to port 2 without phase change and into port 3 at 90 degrees phase change. Similarly, a signal input to port 4 splits into output to port 3 without phase change and into port 2 at 90 degrees phase change. This is captured by the table shown in FIG. 5. However, in the embodiment of FIG. 5 several optional placement for VDC's are shown, all or some of which may be implemented, depending on the desired control over the operation of the hybrid coupler 500.

For example, VDC 503 is provided under the line of input port 1. By applying voltage potential to the electrodes of VDC 503, the phase of the input signal can be controlled. Consequently, the phase at both output ports 2 and 3 would be varied together based on the phase change caused by the voltage potential at VDC 503. This means that the phase at output 2 can be different from the phase of the input signal at input port 1. On the other hand, the phase at output 2 can be changed independently by voltage potential at VDC 507. Consequently, the phase at output port 3 would remain 90° from the input at input port 1, but the phase at output port 2 would be different from zero, depending on the voltage potential applied to VDC 507. Additionally, a voltage potential can be applied to the electrodes of VDC 527 to vary the phase at output port 3 independent of the output at port 2. Thus, the output at port 2 can remain at the same phase as the input at port 1, but the output at port 3 can be modified from 90° with respect to the input at port 1. The same effect can be applied to the input of input port 4 by applying voltage potential to VDC's 523, 507 and 527. Moreover, normally an input signal at port 1 would be split at equal energies between output ports 2 and 3. However, by controlling the voltage potential at VDCs 508, 528, 515A and 515B, the amount of energy delivered to each output port can be changed, thus the amplitude of the output at each port can be controlled.

The cross-section structure of the device shown in FIG. 5 can be seen in the callout of FIG. 5. Element 527 is the variable dielectric constant material, that receive potential from power supplier V. The conductive line 520 is formed on top of a dielectric plate 550, that may be made according to any of the embodiments disclosed herein. For example, it may be made of a sandwich of glass plate and foam plate. The same goes for the back-plate 555, it also may be made according to any of the embodiments disclosed herein. For example, it may be made of a sandwich of glass plate and foam plate.

Thus, as can be understood, according to one aspect, an electronic device is provided, comprising: a back-plate; a dielectric plate; a variable dielectric constant material sandwiched between the back-plate and the dielectric plate; electrodes configured for applying electrical potential to the variable dielectric constant material; and a conductive line formed on top of the dielectric plate; wherein at least one of the dielectric plate and the back-plate comprises a plate of glass and a plate of foam.

FIG. 6 illustrates a variant embodiment for an RF transmission conduit, which may be radiating, non-radiating, or both, e.g., a non-radiating transmission line leading to a radiating patch. In the embodiment of FIG. 6, the dielectric sandwich 200 is made up of two materials: a top layer of PET (Polyethylene terephthalate) 607 having high dielectric constant, a plate of material having dielectric constant close to that of air, for example a structural foam 604 that is mostly air, like, e.g., Rohacell, and a bottom layer of PET 608. The ratio of the thicknesses of the two PET layers and the foam plate, $(h1+h3)/h2$, is calculated to achieve the desired effective dielectric constant. For example, in the example of FIG. 6, a PET layer having dielectric constant of about 4.0 at 3 GHz is used. Depending on the formula used for fabrication of the PET, it may have a somewhat different dielectric constant, but it is within the range of 3.8-4.4.

In the example of FIG. 2, a conductive line or patch 610 is fabricated on the top surface of PET 607. A conductive ground plane 605 is fabricated on the bottom surface of PET 608. Then the PET payers are adhered to the foam core 604. This makes it very easy to fabricate, since the conductive line 610 and conductive ground plane 605 are very easy to fabricate over PET, using various techniques, such as printing, sputtering, plating, etc. Moreover, the conductive circuitry 610 and 605 can be easily fabricated over the PET using reel-to-reel methods, which is fast and economical.

As with all RF antennas, reception and transmission are symmetrical, such that a description of one equally applies to the other. In this description it may be easier to explain transmission, but reception would be the same, just in the opposite direction.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

The invention claimed is:

1. A transmission antenna for RF signal, comprising:
a dielectric plate;
a plurality of radiating patches positioned on one surface of the dielectric plate;
a plurality of delay lines positioned on opposite surface of the dielectric plate, each one of the delay lines coupled to one of the plurality of radiating patches;
a variable dielectric constant (VDC) layer;
a plurality of conductive electrodes abutting the VDC layer, wherein each pair of conductive electrode of the plurality of conductive electrodes corresponds to one of the delay lines;
a ground plane having a plurality of windows, each aligned with one of the delay lines; and,
wherein the dielectric plate comprises a sandwich of at least one high-dielectric constant layer and one foam plate.

2. The transmission conduit of claim 1, wherein the high-dielectric constant layer is formed to have a dielectric constant of 3.8-4.4.

3. The transmission conduit of claim 2, wherein the high-dielectric constant layer is formed of glass.

4. The transmission conduit of claim 2, wherein the high-dielectric constant layer is formed of polyethylene terephthalate.

5. The transmission conduit of claim 1, wherein the foam is formed to have a dielectric constant of 1.0 to 1.1.

6. The transmission conduit of claim 1, wherein the dielectric plate comprises a foam plate sandwiched between a top polyethylene terephthalate (PET) layer, a bottom PET layer.

7. The transmission conduit of claim 1, wherein each radiating patch is coupled to two of the plurality of delay lines.

8. The transmission conduit of claim 1, further comprising a plurality of feed lines, each configured to transmit RE signal to one of the delay lines.

9. An antenna, comprising:
an insulating spacer;
at least one radiating patch provided on top of the insulating spacer;
at least one delay line provided below the insulating spacer;
a variable dielectric constant (VDC) layer provided below the delay line;
a dielectric plate;
a ground plane provided below the dielectric plate;
a bottom insulating plate provided below the ground plane; and,
a feed line provided below the bottom insulating plate;
wherein at least one of: the insulating spacer, the dielectric plate, and the bottom insulating plate, comprises at least one high-dielectric constant layer and one foam plate.

10. The antenna of claim 9, wherein the high-dielectric constant layer comprises one of: Polytetrafluoroethylene, Polyethylene terephthalate (PET), glass fiber impregnated Polypropylene, or glass plate.

11. The antenna of claim 9, wherein the high-dielectric constant layer is formed to have a dielectric constant of 3.8-4.4.

12. The antenna of claim 10, wherein the foam is formed to have a dielectric constant of 1.0 to 1.1.

13. The antenna of claim 9, further comprising conductive electrodes abutting the VDC layer.

14. The antenna of claim 9, wherein at least one of: the insulating spacer, the dielectric plate, and the bottom insulating plate, comprises a foam plate sandwiched between two glass plates.

15. The antenna of claim 9, wherein at least one of: the insulating spacer, the dielectric plate, and the bottom insulating plate, comprises a foam plate sandwiched between two PET plates.

16. The antenna of claim 9, further comprising at least one conductive via connecting each one of the delay lines to a corresponding radiating patch.

17. The antenna of claim 9, wherein the ground plane comprises at least one window, each aligned below a corresponding one of the radiating patches.

18. A method for fabricating an RF transmission antenna, comprising:
forming a conductive circuit over a surface of an insulating plate, the insulating plate comprising one of glass plate or Polyethylene terephthalate (PET);
attaching a ground plane to a surface of a foam plate;
adhering the insulating plate to the foam plate to form a combined plate:
forming a variable dielectric constant (VDC) layer;
forming a plurality of delay lines on a surface of the VDC layer;
forming conductive electrodes on a surface of the VDC layer:
attaching the VDC layer to the combined plate;
forming a plurality of radiating patches and coupling each radiating patch to a corresponding one of the plurality of delay lines.

19. The method of claim 18, wherein attaching a ground plane comprises one of:
forming the ground plane directly on the bottom surface of the foam plate; or
forming the ground plane on a second insulating plate and adhering the second insulating plate to the bottom surface of the foam plate.

20. The method of claim 19, wherein the second insulating plate comprises one of glass plate or Polyethylene terephthalate (PET).

* * * * *